US008613631B2

(12) United States Patent
Hemmi et al.

(10) Patent No.: US 8,613,631 B2
(45) Date of Patent: Dec. 24, 2013

(54) ELECTRICAL CONNECTOR

(75) Inventors: Yoshinobu Hemmi, Kawasaki (JP); Naoyuki Kimura, Fuchu (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 1293 days.

(21) Appl. No.: 12/132,210

(22) Filed: Jun. 3, 2008

(65) Prior Publication Data

US 2008/0305659 A1 Dec. 11, 2008

(30) Foreign Application Priority Data

Jun. 6, 2007 (JP) ..... 2007-150400

(51) Int. Cl.
*H01R 3/00* (2006.01)
*H01R 13/15* (2006.01)

(52) U.S. Cl.
USPC ..... 439/495; 439/260; 439/910

(58) Field of Classification Search
USPC ..... 439/492, 493, 495, 499, 862, 873, 871, 439/746, 751, 910, 260, 259
See application file for complete search history.

(56) References Cited

U.S. PATENT DOCUMENTS

| | | | | |
|---|---|---|---|---|
| 4,975,076 | A * | 12/1990 | Mosquera | 439/387 |
| 5,498,169 | A * | 3/1996 | Ikemoto | 439/260 |
| 6,203,345 | B1 | 3/2001 | Roque et al. | |
| 7,044,773 | B2 * | 5/2006 | Suzuki et al. | 439/495 |
| 2005/0239345 | A1 * | 10/2005 | Furuno et al. | 439/751 |

FOREIGN PATENT DOCUMENTS

| | | | |
|---|---|---|---|
| CN | 1295359 | A | 5/2001 |
| CN | 2862383 | Y | 1/2007 |
| JP | 2002-190360 | A | 7/2002 |
| JP | 2003-223960 | A | 8/2003 |
| JP | 2004-071160 | A | 3/2004 |
| JP | 2006-261140 | A | 9/2006 |

OTHER PUBLICATIONS

Notice of Preliminary Rejection for Korean Application No. 10-2008-0025238 mailed on Jun. 15, 2009 and English translation thereof, 5 pages.
Chinese Examination Report for Application No. 2008100935668, mailed on Nov. 27, 2009 (6 pages).
English abstract for Chinese Patent Publication No. 2862383, publication date Jan. 24, 2007, OutLineContinue database, (1 page).
Japanese Office Action for Application No. 2007-150400, mailed on Nov. 22, 2011 (4 pages).

* cited by examiner

*Primary Examiner* — Felix O Figueroa
(74) *Attorney, Agent, or Firm* — Osha Liang LLP

(57) ABSTRACT

An electrical connector includes a first insertion hole and a second insertion hole made on the same straight line in both side faces facing each other in a base, a support contact piece of a first connecting terminal and a second connecting terminal laterally inserted into the first insertion hole and the second insertion hole respectively, and an operation lever rotatably attached to a side face on one side of the base while a front end portion of an FPC is inserted from an opening formed in a side face on the other side of the base. An inspection hole communicated with the first insertion hole and the second insertion hole is made in a bottom surface of the base such that a front end portion of the inserted first connecting terminal and a latch portion of the inserted second connecting terminal can visually be observed.

3 Claims, 6 Drawing Sheets

ELECTRICAL CONNECTOR

BACKGROUND OF THE INVENTION

1. Field of the Invention

The present invention relates to an electrical connector, particularly to an electrical connector which is connected to connecting portions provided in parallel in a surface and a backside of a front end portion of a flexible printed circuit board (hereinafter referred to as "FPC").

2. Description of the Related Art

Conventionally, there is known, for example, an electrical connector disclosed in Japanese Patent Application Laid-Open No. 2002-190360. As shown in FIGS. 4 and 6 of Japanese Patent Application Laid-Open No. 2002-190360, in the electrical connector, a clipping operation contact piece 12 and an opposing-side contact piece 13 are inserted and assembled from opposite openings in a housing 4.

Further, an operator 16 rotatably supported in one of the openings of the housing 4 is rotated to drive the clipping operation contact piece 12, whereby electrical conduction is established by clipping printed wiring terminals 10 and 10 of FPC 2 between a contact portion 25 of the clipping operation contact piece 12 and a touch portion 26*a* of the opposing-side contact piece 13.

However, in the electrical connector, it is necessary that the clipping operation contact piece 12 and the opposing-side contact piece 13 be inserted and assembled in the housing 4. Because of miniaturization of the apparatus, it is difficult to make a determination whether or not the clipping operation contact piece 12 and the opposing-side contact piece 13 are correctly placed into predetermined positions. Therefore, a variation in support strength is easily generated due to a shift of clipping position between the contact portion 25 and the touch portion 26*a*, which results in low contact reliability.

In view of the foregoing, an object of the present invention is to provide an electrical connector in which assembly of connecting terminals is easily confirmed, the variation in support strength is not generated, and the contact reliability is improved.

SUMMARY OF THE INVENTION

In order to solve the above problems, according to an aspect of the present invention, there is provided an electrical connector in which a first insertion hole and a second insertion hole are made on an identical straight line in both side faces facing each other in a base, a support contact piece of a first connecting terminal and a second connecting terminal are laterally inserted into the first insertion hole and the second insertion hole respectively, an operation lever is rotatably attached to a side face on one side of the base while an FPC is inserted from an opening formed in a side face on the other side of the base, and the operation lever is rotated to operate one end portion of an operation contact piece connected from a front end portion of the support contact piece through a coupling portion, whereby a front end portion of the FPC is clipped between a movable contact provided in the other end portion of the operation contact piece and a fixed contact of the second connecting terminal while the movable contact of the first connecting terminal and the fixed contact of the second connecting terminal are connected to connecting portions provided in parallel in a surface and a backside of the front end portion of the FPC, wherein an inspection hole communicated with the first insertion hole and the second insertion hole is made in a bottom surface of the base such that a front end portion of the inserted first connecting terminal and a front end portion of the inserted second connecting terminal can visually be observed.

Accordingly, in the aspect of the present invention, the front end portion of the first connecting terminal and the front end portion of the second connecting terminal can visually be observed from the inspection hole made in the bottom surface of the base. Therefore, a confirmation whether or not the first and second connecting terminals are correctly placed into predetermined positions can be made to eliminate the variation in support strength caused by the variation in assembly accuracy, and the electrical connector having the high contact reliability can be obtained.

In the electrical connector according to an embodiment of the present invention, preferably at least one bent portion is formed in the support contact piece of the first connecting terminal so as to be laterally projected toward a direction orthogonal to the insertion direction of the support contact piece, and the projected surface of the bent portion is supported while press-contacting an inside surface of a press-fitting groove.

According to the embodiment, the first connecting terminal can be fixed to the first insertion hole in the base with the bent portion interposed therebetween. Therefore, it is not necessary to make the long first insertion hole, and the electrical connector having the small width and the small floor area can be obtained.

In the electrical connector according to another embodiment of the present invention, preferably projections are provided in upper and lower end faces of the bent portion, the projections press-contacting at least one of upper and lower surfaces of the first insertion hole.

Accordingly, because the bent portion is supported in the insertion hole by not only the projection surface but also the projections provided in the upper and lower end faces, the electrical connector having the larger support strength can be obtained.

DETAILED DESCRIPTION OF THE PREFERRED EMBODIMENTS

Figure 1A:
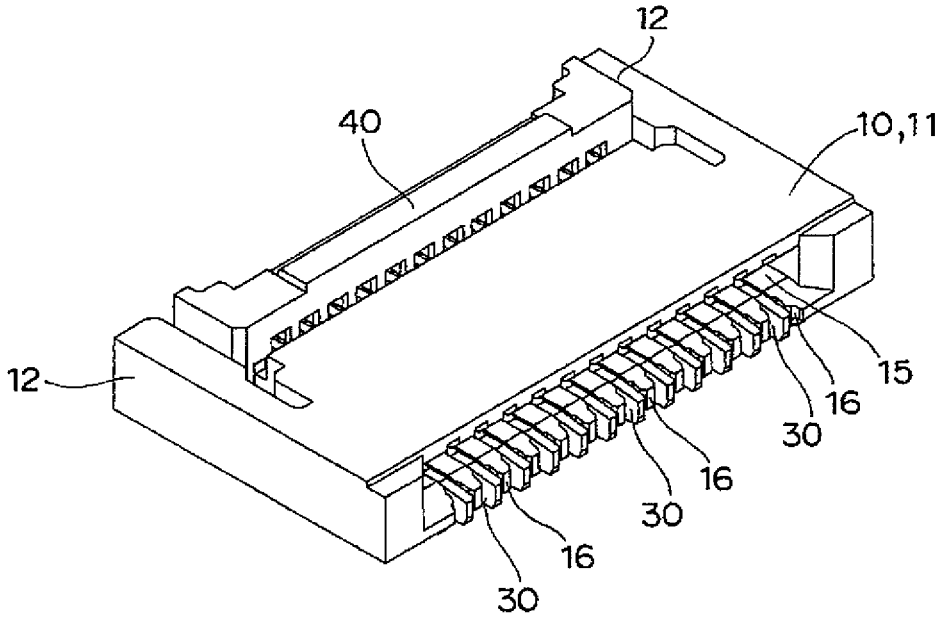
FIGS. 1A and 1B show perspective views of an electrical connector according to a first embodiment of the present invention when viewed from different angles.

Preferred embodiments of the present invention will be described below with reference to the accompanying drawings, FIGS. 1 to 6. As shown in FIGS. 1 to 4, an electrical connector 10 according to a first embodiment of the present invention includes a base 11, a first connecting terminal 20, a second connecting terminal 30, and an operation lever 40.

Figure 1B:
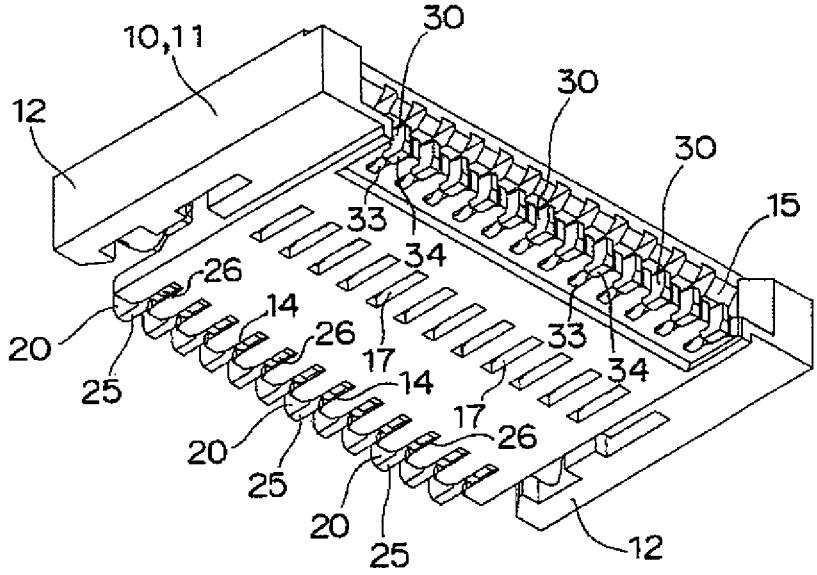
Figure 2A:
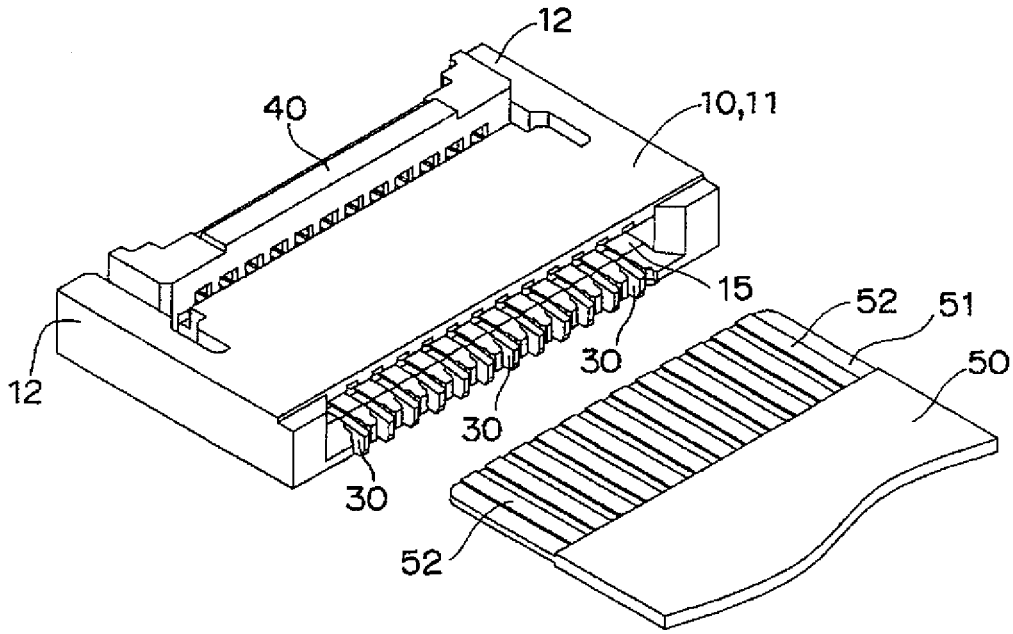
FIGS. 2A and 2B show perspective views for explaining a method of mounting an FPC on the electrical connector of FIG. 1.
Figure 2B:
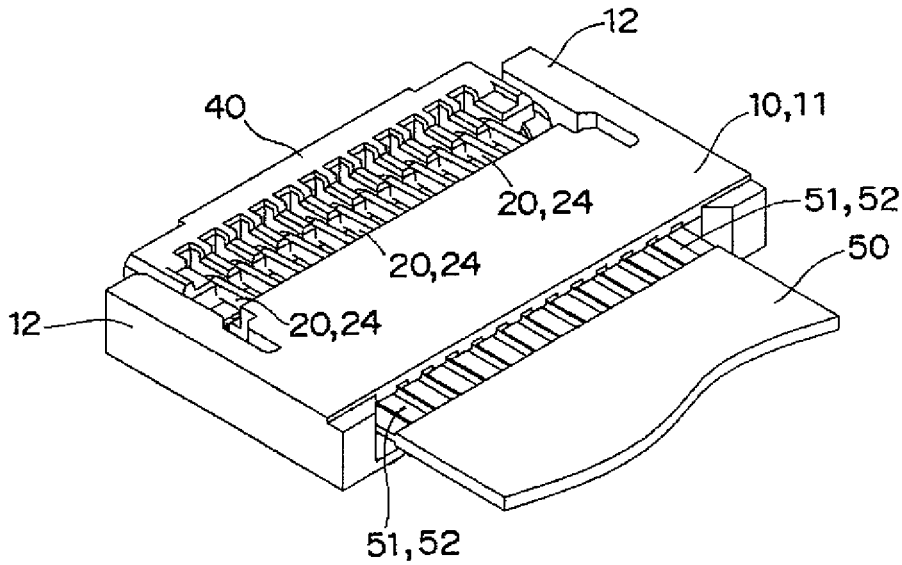
Figure 4A:
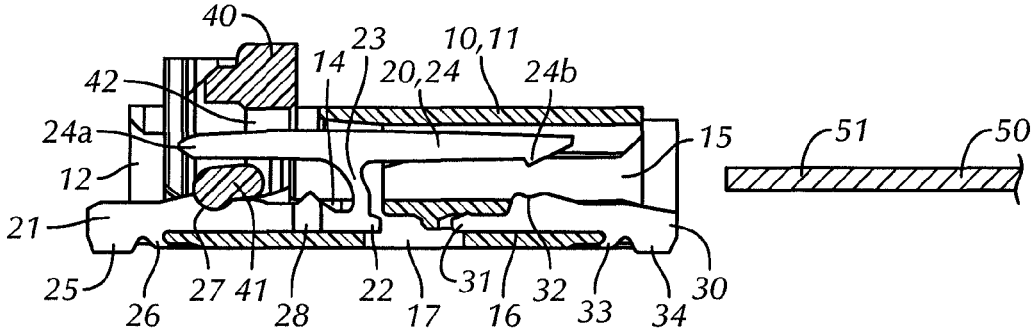
FIGS. 4A to 4C show sectional views for explaining a method of mounting the FPC on the electrical connector of the present invention.
Figure 4B:
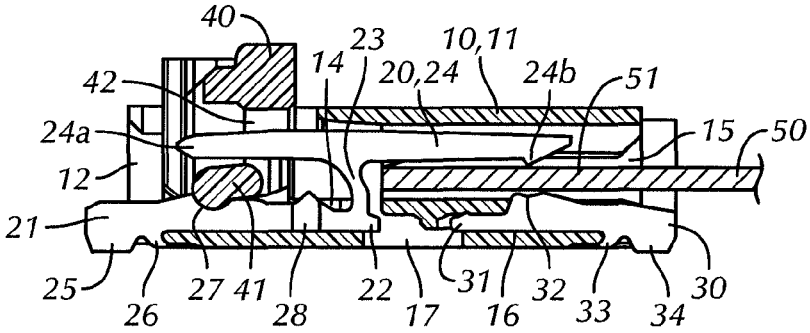
Figure 4C:
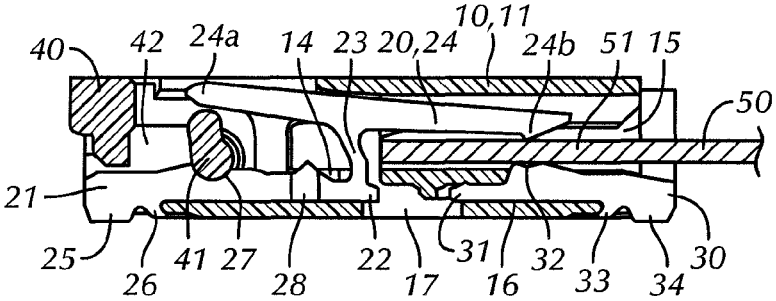

As shown in FIGS. 1, 2, and 4, on a rear face side of the base 11, elastic arm portions 12 and 12 are extended in parallel from edge portions of an end face. An operation lever 40, which will be described later, is rotatably assembled between the elastic arm portion 12 and 12. In the base 11, plural insertion holes 14 and 16 are made at predetermined intervals in opposing front and rear faces respectively, and the insertion holes 14 and 16 are located on the same straight line. An opening 15 into which a front end portion 51 of an FPC 50 is inserted is provided in the front face of the base 11.

Figure 3A:
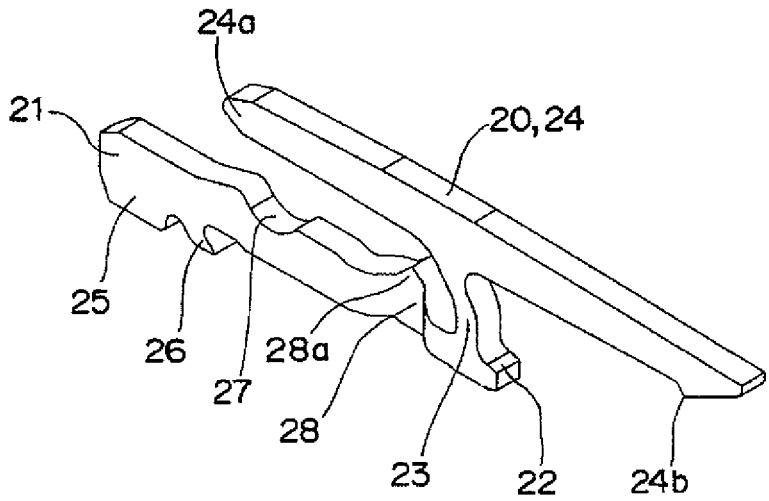
FIGS. 3A and 3B show perspective views of a first connecting terminal when viewed from different angles.
Figure 3B:
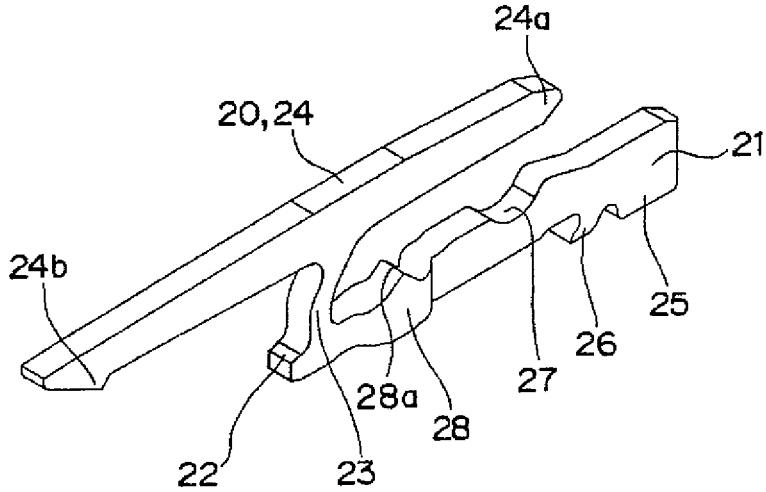

As shown in FIG. 3, the first connecting terminal 20 includes a support contact piece 21 and an operation contact piece 24. The support contact piece 21 is inserted into the first insertion hole 14 of the base 11. The operation contact piece 24 is connected to the support contact piece 21 while a coupling portion 23 is interposed therebetween, and the coupling portion 23 is extended upward from a front end portion 22 of the support contact piece 21. In one end portion of the support contact piece 21, a connecting portion 25 and a latching pawl 26 are formed in a lower edge portion. A bearing portion 27 is formed in an upper edge portion in the center of the support contact piece 21 to rotatably support an operating cam portion 41 of an operation lever 40, which will be described later. In the support contact piece 21, a bent portion 28 is formed near a base portion of the coupling portion 23, and the bent portion 28 is laterally bent by performing ejection forming in a thickness direction. A latching projection 28*a* is provided in an upper end face of the bent portion 28. In the operation contact piece 24, one of end portions constitutes an operation receiving portion 24*a*, and the other end portion constitutes a movable contact 24*b*.

As shown in FIG. 4, the second connecting terminal 30 includes a latch portion 31 and a fixed contact portion 32. The latch portion 31 is of a front end portion which is inserted into and latched in the second insertion hole 16 of the base 11. The fixed contact portion 32 is formed in an upper edge portion in a central portion of the second connecting terminal 30. The fixed contact portion 32 has a recess in an upper end portion. Further, in the second connecting terminal 30, a latching pawl 33 and a connecting portion 34 are formed in a lower edge portion of a rear end portion.

As shown in FIGS. 1 and 4, an operating cam portion 41 is provided between rotating shaft portions (not shown) coaxially projected on both sides in an end face of the operation lever 40. The operating cam portion 41 is used to operate the operation contact piece 24 of the first connecting terminal 20. A through-hole 42 into which the operation receiving portion 24*a* of the first connecting terminal 20 is inserted is made at the back of the operating cam portion 41.

As shown in FIG. 2, in the FPC 50 connected to the electrical connector 10 of the first embodiment, connecting portions 52 in which printed wiring is performed are provided in upper and lower surfaces of a front end portion 51 (connecting portions 52 in a lower surface are not shown), and the connecting portions 52 are provided in parallel at predetermined intervals.

A method of assembling the components will be described below. The second connecting terminal 30 is laterally slid in the insertion hole 16 of the base 11, and the latch portion (front end portion) 31 and the latching pawl 33 are latched and assembled in the base 11. At this point, the latch portion 31 can visually be observed from an inspection hole 17 of the base 11 to confirm whether or not the second connecting terminal 30 is correctly placed into a predetermined position.

Then, the support contact piece 21 of the first connecting terminal 20 is inserted along an insertion hole 14 of the base 11, whereby the latching projection 28*a* of the bent portion 28 is latched in a ceiling surface of the insertion hole 14 while the bent portion 28 of the first connecting terminal 20 press-contacts an inside surface of the insertion hole 14. As a result, the front end portion 22 of the first connecting terminal 20 can visually be observed from the inspection hole 17 of the base 11 to confirm whether or not the first connecting terminal 20 is correctly placed into a predetermined position.

Then, a rotating shaft portion of the operation lever 40 is rotatably engaged with the elastic arm portions 12 and 12, and the operation receiving portion 24*a* of the operation contact piece 24 is inserted and assembled in the through-hole 42. Therefore, the operating cam portion 41 of the operation lever 40 is rotatably supported on the bearing portion 27 of the first connecting terminal 20, and the assembly work is completed.

A method of connecting and fixing the FPC 50 to the electrical connector 10 will be described below.

As shown in FIG. 4, the front end portion 51 of the FPC 50 is inserted from the opening 15 of the base 11 until the front end portion 51 abuts on the inside surface of the base 11. When the operation lever 40 is rotated and pushed down, the operating cam portion 41 of the operation lever 40 is rotated to press up the operation receiving portion 24*a* of the first connecting terminal 20. Therefore, the operation contact piece 24 is inclined, and the movable contact 24*b* presses down the front end portion 51 while press-contacting the connecting portions 52 provided in the upper surface of the front end portion 51 of the FPC 50, thereby the fixed contact 32 of the second connecting terminal 30 press-contacts the connecting portions 52 provided in the lower surface of the front end portion of the FPC 50.

According to the first embodiment, in connecting the electrical connector 10 to the FPC 50, the neighborhood of the coupling portion 23 on which an uplifting force acts is surely fixed to the base with the bent portion 28 interposed therebetween. Therefore, a contact force can be ensured without loosening an operating force of the operation lever 40, so that the contact reliability can be enhanced.

The operation lever 40 is stably moved, because the bearing portion 27 constituting a rotating support point of the operation lever 40 is disposed between the bent portion 28 of the first connecting terminal 20 and the edge portion of the base 11 to which the first connecting terminal 20 is fixed. Therefore, a displacement amount of the movable contact 24*b* of the first connecting terminal 20 is stabilized and the contact force acting on the FPC 50 is stabilized, so that the contact reliability can be enhanced.

Additionally, the operation contact piece 24 of the first connecting terminal 20 can follow the wiring of the FPC 50 while the base portion located between the bent portion 28 and the coupling portion 23 constitutes the support point, so that the contact reliability can further be enhanced.

Additionally, because the recess is formed in the top of the fixed contact portion 32, advantageously the contact reliability is enhanced and the FPC 50 hardly drops off.

Figure 5A:
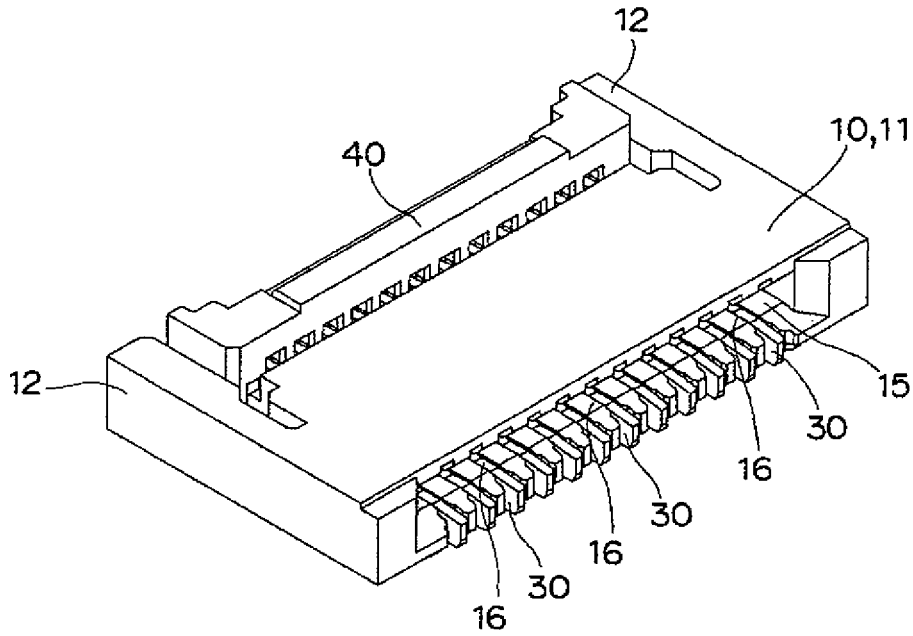
FIGS. 5A and 5B show perspective views of an electrical connector according to a second embodiment of the present invention when viewed from different angles.
Figure 5B:
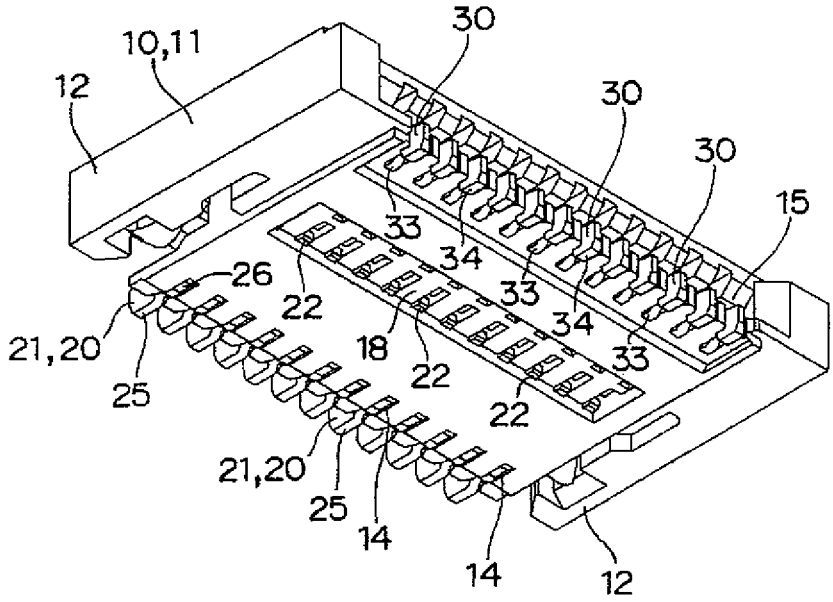
Figure 6A:
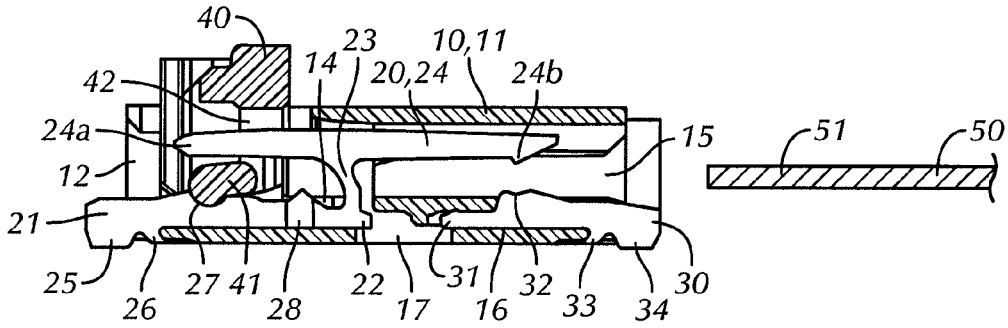
FIGS. 6A to 6C show sectional views for explaining a method of mounting the FPC on the electrical connector of the present invention.
Figure 6B:
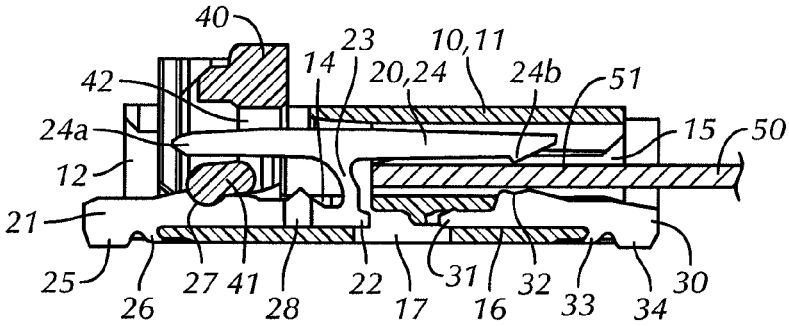
Figure 6C:
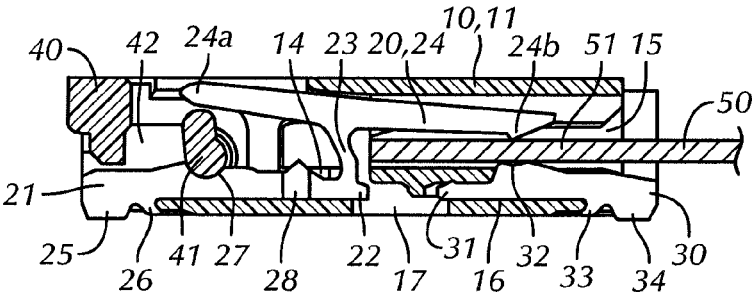

As shown in FIGS. 5 and 6, a basic structure according to a second embodiment of the present invention is substantially similar to that of the first embodiment. The second embodiment differs from the first embodiment in that an inspection recess 18 which is of an inspection hole is provided in the lower surface of the base 11 such that the entire front end portion 22 of the first connecting terminal 20 and the entire latch portion 31 of the second connecting terminal 30 can visually be observed.

According to the second embodiment, the one inspection recess 18 is simply provided, which advantageously facilitates production of the metallic mold.

The present invention is not limited to the electrical connectors of the embodiments, but the present invention can obviously be applied to other electrical connectors.

What is claimed is:

1. An electrical connector in which a first insertion hole and a second insertion hole are made on an identical straight line in both side faces facing each other in a base, a support contact piece of a first connecting terminal and a second connecting terminal are laterally inserted into the first insertion hole and the second insertion hole respectively, an operation lever is rotatably attached to a side face on one side of the base while an FPC is inserted from an opening formed in a side face on the other side of the base, and the operation lever is rotated to operate one end portion of an operation contact piece connected from a front end portion of the support contact piece through a coupling portion, whereby a front end portion of the FPC is clipped between a movable contact provided in the other end portion of the operation contact piece and a fixed contact of the second connecting terminal while the movable contact of the first connecting terminal and the fixed contact of the second connecting terminal are connected to connecting portions provided in parallel in a surface and a backside of the front end portion of the FPC, wherein an inspection hole communicated with the first insertion hole and the second insertion hole is made in a bottom surface of the base such that a front end portion of the inserted first connecting terminal and a front end portion of the inserted second connecting terminal can visually be observed.

2. The electrical connector according to claim 1, wherein at least one bent portion is formed in the support contact piece of the first connecting terminal so as to be laterally projected toward a direction orthogonal to the insertion direction of the support contact piece, and the projected surface of the bent portion is supported while press-contacting an inside surface of a press-fitting groove.

3. The electrical connector according to claim 2, wherein projections are provided in upper and lower end faces of the bent portion, the projections press-contacting at least one of upper and lower surfaces of the first insertion hole.

* * * * *